US010448179B2

(12) United States Patent
Mäkivirta et al.

(10) Patent No.: US 10,448,179 B2
(45) Date of Patent: Oct. 15, 2019

(54) PERSONAL SOUND CHARACTER PROFILER

(71) Applicant: Genelec Oy, Iisalmi (FI)

(72) Inventors: Aki Mäkivirta, Iisalmi (FI); Jussi Tikkanen, Iisalmi (FI); Juha Urhonen, Iisalmi (FI); Thomas Lund, Iisalmi (FI)

(73) Assignee: Genelec Oy, Iisalmi (FI)

( * ) Notice: Subject to any disclaimer, the term of this patent is extended or adjusted under 35 U.S.C. 154(b) by 0 days.

(21) Appl. No.: 15/620,705

(22) Filed: Jun. 12, 2017

(65) Prior Publication Data

US 2018/0359581 A1 Dec. 13, 2018

(51) Int. Cl.
*H04R 29/00* (2006.01)
*H04S 7/00* (2006.01)

(52) U.S. Cl.
CPC ..... *H04R 29/001* (2013.01); *H04R 29/008* (2013.01); *H04S 7/301* (2013.01); *H04R 2499/15* (2013.01)

(58) Field of Classification Search
CPC .. H04R 3/04; H04R 2430/01; H04R 2430/03; H04R 2499/13; H03G 3/00; H03G 5/005; H03G 5/165; H03G 3/3005; H03G 9/005; H03G 9/025; H03G 3/3089; H03G 3/32; H03G 5/025; H03G 5/00; H04S 1/002; H04S 7/307; H04S 2400/03; G10K 11/178; G10K 11/1782; G10K 2210/3028; G10K 2210/3056; G10L 21/0205; G10L 21/0316; G10L 21/0364; G10L 25/90
USPC ..... 381/56–59, 98, 103–107; 700/94
See application file for complete search history.

(56) References Cited

U.S. PATENT DOCUMENTS

| | | | | |
|---|---|---|---|---|
| 9,236,842 | B2 * | 1/2016 | Katsianos | H03G 3/00 |
| 2007/0244930 | A1 * | 10/2007 | Bartlette | G06F 9/44505 |
| 2013/0163784 | A1 * | 6/2013 | Tracey | H03G 3/00 381/103 |
| 2013/0287227 | A1 * | 10/2013 | Wallander | G10L 21/0316 381/103 |
| 2014/0029615 | A1 * | 1/2014 | Baldwin | H04L 67/306 370/392 |
| 2014/0153745 | A1 * | 6/2014 | Mate | H03G 5/005 381/103 |
| 2017/0188172 | A1 * | 6/2017 | Horbach | H04R 5/0335 |

* cited by examiner

*Primary Examiner* — Lun-See Lao
(74) *Attorney, Agent, or Firm* — Seppo Laine Oy; Toimi Teelahti

(57) ABSTRACT

According to an exemplary aspect of the present invention, there is provided an apparatus comprising: at least one loudspeaker element, at least one processing core, at least one memory including computer program code, the at least one memory and the computer program configured to, with the at least one processing core, cause the apparatus to produce sound via the loudspeaker element, wherein the at least one processing core is configured to adjust the sound according to criteria stored in the at least one memory, wherein the criteria comprise a wide bandwidth roll-off using at least one parametric shelving filter.

11 Claims, 2 Drawing Sheets

PERSONAL SOUND CHARACTER PROFILER

BACKGROUND

The present invention relates to calibrating audio systems, more specifically to calibrating loudspeaker systems in differing acoustical environments.

SUMMARY OF THE DISCLOSURE

This invention comprises a Personal Sound Character Profiler (PSCP) that enables the user to create his own preferred sound character which he can then apply to any calibrated loudspeaker system. The PSCP equalization is done on the loudspeaker level, therefore no extra equipment is required. This allows the user to work with high reliability in acoustically differing rooms and still get the sound which he is familiar with. In other words, the user can trust that the system has a similar sound profile due to the calibration and equalization process. The profile created by the PSCP can be stored. When the user goes to another monitoring room where the reproduction system has been calibrated, he can apply his personal profile (PSCP profile) to the new loudspeaker system to experience the same sound character also in the other room. This eliminates the need for manual fine-tuning of the sound system. PSCP will be implemented globally for the whole multi-loudspeaker monitoring system in a single process, using a single graphical user interface, instead of having to modify the settings in each monitor or speaker individually. The PSCP can be used to quickly set the user's personal preference for whole multi-loudspeaker monitoring system, using the single graphical user interface. The application of the sound character profile PSCP can be automatic.

The invention is defined by the features of the independent claims. Some specific embodiments are defined in the dependent claims.

According to a first aspect of the present invention, there is provided an apparatus comprising: at least one loudspeaker element, at least one processing core, at least one memory including computer program code, the at least one memory and the computer program configured to, with the at least one processing core, cause the apparatus to produce sound via the loudspeaker element, wherein the at least one processing core is configured to adjust the sound according to criteria stored in the at least one memory, wherein the criteria comprise a wide bandwidth roll-off using at least one parametric shelving filter.

According to another aspect of the present invention, there is provided an apparatus according to any of the previous aspects wherein the apparatus is configured to receive the criteria from an external system.

According to another aspect of the present invention, there is provided an apparatus according to any of the previous aspects, wherein the criteria comprise at least two parametric shelving filters.

According to another aspect of the present invention, there is provided an apparatus to any of the previous aspects, wherein the parameters of the shelving filter comprise at least one of the frequency location of the filter and the slope of the filter profile.

According to another aspect of the present invention, there is provided an apparatus according to any of the previous aspects, wherein the filter comprises band stop or band pass characteristics.

According to another aspect of the present invention, there is provided an apparatus according to any of the previous aspects, wherein the apparatus is configured to effect the adjustment using additional signal processing filters in the memory.

According to another aspect of the present invention, there is provided an apparatus according to any of the previous aspects, wherein the apparatus is configured to generate the criteria at least in part in response to input obtained via a graphical user interface.

According to another aspect of the present invention, there is provided an apparatus according to any of the previous aspects, wherein the apparatus is further configured to store the criteria on an external device.

According to another aspect of the present invention, there is provided an apparatus according to any of the previous aspects, wherein the apparatus is configured to use the criteria with headphones.

According to another aspect of the present invention, there is provided an apparatus according to any of the previous aspects wherein the apparatus comprises an amplifier.

According to another aspect of the present invention, there is provided a method of adjusting the sound of an audio system, the method comprising; calibrating the audio system at a physical listening position to produce a first response, generating a first configuration setting, based on the first configuration setting, generating an individual configuration setting, comprising criteria, for a speaker, applying the respective configuration setting in each individual speaker, adjusting the output of each individual speaker based on the individual configuration setting to produce a second response, wherein the individual configuration setting is stored in a memory physically associated with the loudspeaker.

According to another aspect of the present invention, there is provided a method according to the previous aspect, the method comprising; wherein the individual speakers are of different types or models.

According to another aspect of the present invention, there is provided a method according to the previous aspect, the method comprising; wherein the configuration setting is generated on an external system.

According to another aspect of the present invention, there is provided a method according to the previous aspect, wherein the criteria comprises at least one parametric shelving filter.

According to another aspect of the present invention, there is provided a method according to the previous aspect, wherein the parameters of the at least one shelving filter comprises at least one of the frequency location of the filter and the slope of the filter profile.

According to another aspect of the present invention, there is provided a method according to the previous aspect, wherein the adjustment is effected using additional signal processing filters in the memory.

According to another aspect of the present invention, there is provided a method according to the previous aspect, wherein the filter comprises band stop or band pass characteristics.

According to another aspect of the present invention, there is provided a method according to the previous aspect, wherein the criteria is generated via a graphical user interface.

According to another aspect of the present invention, there is provided a method according to the previous aspect, wherein the configuration setting is additionally stored on an external device.

According to another aspect of the present invention, there is provided a method according to the previous aspect, wherein the configuration setting is used for headphones.

DETAILED DESCRIPTION

Figure 1:
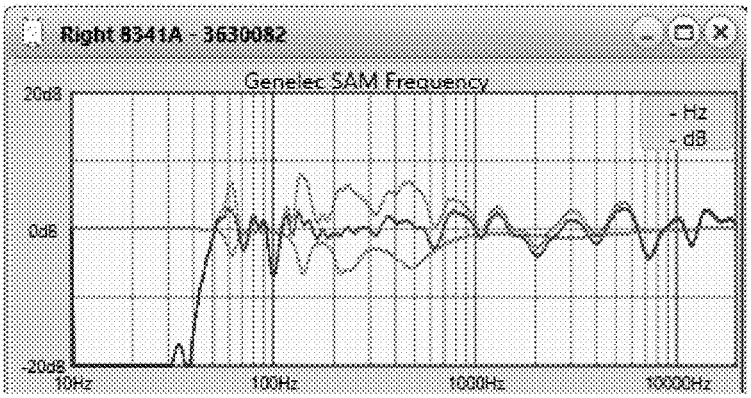
FIG. 1 illustrates a room response measured from a calibrated sound system in accordance with at least some embodiments of the present invention.

This invention comprises a Personal Sound Character Profiler (PSCP) that enables the user to create his own preferred sound character based on the calibrated flat frequency response at the listening position. He can then apply that preferred sound character to any calibrated loudspeaker system. This allows the user to work with high reliability in acoustically differing rooms and still get the sound which he is familiar with for different sound production applications.

The listening space has a significant effect on an audio system's sound output. When the effect of the listening space is minimized by calibrating the speaker system, this results in a system having a more consistent sound character with a flat frequency response at the listening position. In this way, the different acoustic spaces (rooms) begin to sound more systematically similar than without calibration. This results in a neutral sound character; this means sound that doesn't decrease or increase certain frequencies but contains an equal amount of all audible frequencies—i.e. a flat frequency response. However, a neutral sound character does not necessarily reflect a person's expectation or perception of what a loudspeaker system should sound like. This means that the listener's expectation of the sound character may deviate from a neutral system response due to his listening habits, audio material she/he intends to produce or listen to, etc. For example, typical expectations might be the relative level of the bass frequencies relative to the mid and high frequencies (case A) or the level of the very high frequencies relative to the mid frequencies (case B). In another case, the user may have a hearing deficiency at certain frequencies or in one ear, for example. In these cases, a neutral sound character might not satisfy the user's needs.

It is possible to use separate audio processing and filtering device(s) to modify the audio signal to have a personalized room response. This can require separate manual acoustic measurement of the monitor room responses, which is a time-intensive process. The settings must also be manually set into the device(s). Applying such methods requires a good understanding of room acoustics and audio equipment.

In an exemplary situation, a user works in several different studios with calibrated speaker systems, resulting in minimized or reduced room effect on the sound. However, even though the rooms have a similar sound, the user might not like the sound or the sound may not match the user's needs or perception. To achieve the sound he likes, the user can manually fine tune the system calibration. This takes time and it is not always easy to do.

This invention comprises a Personal Sound Character Profiler (PSCP) that enables the user to fine-tune the sound system character in terms of the Cases A and B or any other approaches to fine-tune the spectrum balance of the sound. In the context of this disclosure, the sound system comprises at least one speaker element such as a loudspeaker, headphones, subwoofer, etc. The profile created by the PSCP can be stored. When the user goes to another monitoring room where the reproduction system has been calibrated, he can apply his personal profile (PSCP profile) to the new loudspeaker system to experience the same or his/her preferred sound character also in the next room or listening environment. This eliminates the need to manually fine tune the sound system. The PSCP will be implemented globally for the whole multi-loudspeaker monitoring system in a single process, using one command from graphical user interface, instead of having to modify the settings in each monitor or speaker individually. On a technical level, the PSCP is implemented using the additional signal processing filters present in each individual loudspeaker. The individual speaker configuration is stored in the memory of the loudspeaker. The global implementation is done via the control network—the control software is aware of the speaker configuration and applies the settings to the speakers via the network. If, for some reason, e.g. during the system setup process, the control software is not aware or has old information regarding the speaker configuration, the software has the ability to query the speakers connected to the system and adjust the configuration based on the received answers to the query.

In an exemplary use case, the personal profiler enables the user to create his own preferred sound character in relation to the reference calibrated flat frequency. The user can then apply the created sound character to any calibrated loudspeaker system. This enables the user to work with high reliability in acoustically differing rooms and still get the preferred sound which he is familiar with. Therefore, one advantage provided by the PSCP is reducing or completely eliminating the effect of differing room acoustics on types of work such as audio engineering, mixing, composing, etc. The system also reduces the need of adjusting the audio system manually each time a different user utilizes the space or the loudspeaker system setup. Additionally, the PSCP may reduce the amount of hardware the user needs to achieve the sound they prefer, as no additional equalizing hardware is required. In another use case, a sound engineer might not be on site but would still like to check and adjust the sound of a location. The engineer could use PSCP at the remote location to ensure that the sound is correct based on his/her preference.

The PSCP lets the user to quickly set the personal preference for whole multi-loudspeaker monitoring system, using the single graphical user interface. The application of the sound character profile PSCP may performed automatically, for example based on criteria comprising one of the following: user identification, on the type of audio hardware being used, the type of instruments or music being played, the location of the speaker system, environmental variables such as humidity and temperature.

There can be also factory-defined or user-defined presets for the PSCP to enable quick access more than one PSCP setting. Several PSCP profiles can be offered to the user via the graphical user interface. There can be several storage locations for the PSCP settings, enabling storage and quick retrieval of any of the stored PSCP settings. Storage locations may comprise at least one of the following: a loudspeaker, an external control unit, a personal computer, a smart device, a remote server (i.e. 'the cloud'), a memory stick, additional audio equipment.

This invention minimizes the number of devices in the system and does not necessarily require deep understanding of the measurement technology or acoustics. Personal profiler is a signal processing method that uses a set of user controls which enable the user to adjust the system sound. The equalization is done in the loudspeaker and therefore no extra equipment is required. If the user so desires, the personal profile settings can be stored in the loudspeakers, which enables the use of the PSCP profile without having a computer.

Figure 4:
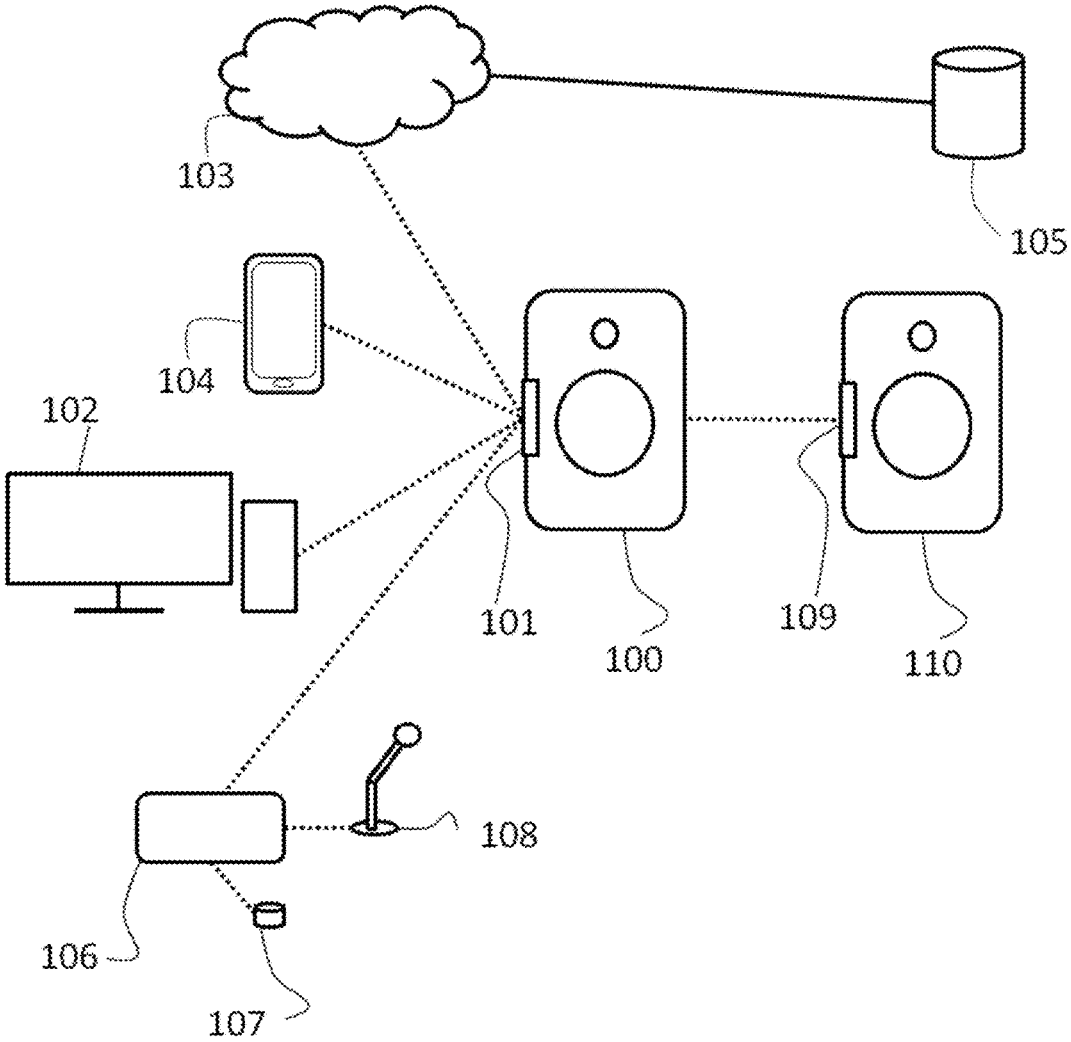
FIG. 4 illustrates a loudspeaker (100) with a control module (101) paired with a second loudspeaker (110) with a control module (109). The loudspeakers are connected to an external control unit (106) further connected to peripherals such as a microphone (108) and a volume control (107). In addition, the loudspeakers may be connected to a server (105) via an external network, i.e. the cloud (103) or additionally or alternatively to a mobile device (104) or a personal computer (102).

An exemplary process to utilize the PSCP is as follows:

1. Loudspeaker system is calibrated at the listening position to minimize room effect to the sound and to achieve a flat frequency response as indicated in FIG. 1.
2. The user sets his personal profile using the graphical user interface controller and by listening to the loudspeaker system sound as demonstrated in FIG. 2.
3. When he is pleased with the system sound, the user stores the profile PSCP profile settings in a user-selected location, or, optionally, the settings are automatically saved.
4. The profile settings can be stored locally in the computer or in the loudspeakers or in the cloud (a remote computer system), as shown in FIG. 4,
5. The user can access the PSCP profile on the remote computer system using his personal user name and password.

Figure 2:
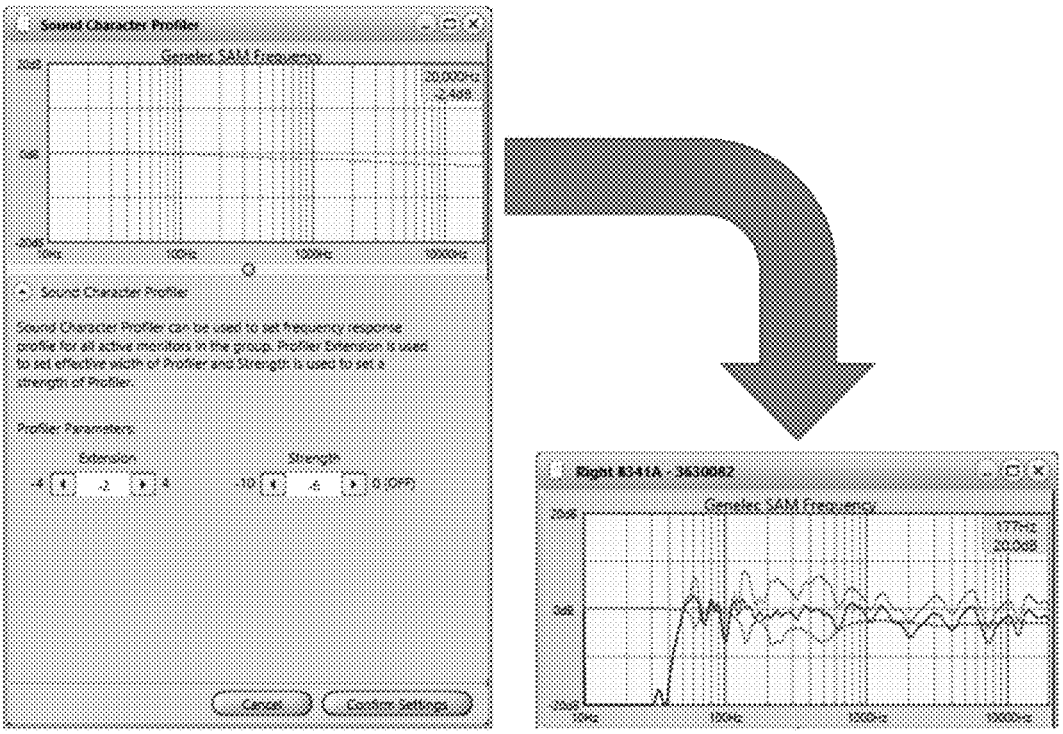
FIG. 2 illustrates a Personal Sound Character Profiler (PSCP) graphical user interface (left) and the resulting personalized room response (right) in accordance with at least some embodiments of the present invention.
Figure 3:
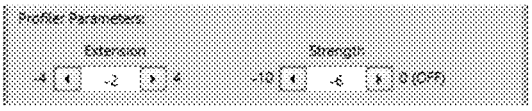
FIG. 3 illustrates Personal Sound Character Profiler parameters in an exemplary user interface in accordance with at least some embodiments of the present invention.

The PSCP profiler can be adjusted, tuned, or controlled by manual operation by the user or an administrator, using a graphical user interface, as shown in FIGS. 1-3. Personal Sound Character Profiler can also be automatically adjusted, for example based on criteria comprising user identity, hardware identity, location-related criteria, measured results, iterative tuning, or calculations or evaluations done off-site. These criteria may be stored in a database located in any of the storage locations the PSCP profile may be saved at, as previously discussed in this disclosure.

The user can set the desired PSCP target response profile. While the loudspeaker system is calibrated after the target response profile is set, the automatic calibration targets directly the PSCP response instead of the flat response. In this case, the user will not need to activate the PSCP after the calibration. If so desired, the PSCP can continue to be activated on subsequent calibrations automatically.

There can be also factory-designed PSCP profiles. Factory-designed profiles may, for example, be based on user identification, on the type of audio hardware being used, the type of instruments or music being played, the location of the speaker system, environmental variables such as humidity and temperature.

The user can define and store several PSCP presets to enable quick access to more than one PSCP setting. The user can provide descriptive names for the presets. The presets may incorporate metadata comprising date or time information, user identification.

The PSCP has at least two parameters. Parameters have descriptive names, such as extension and strength. In one embodiment, the PSCP implements a wide bandwidth roll-off using two shelving filters. A roll-off means that the response is adjusted to form a slope, e.g. to zero, starting or ending at the desired frequency. A roll-off differs from a cut-off in that a cut-off will exhibit an abrupt transition, while a roll-off will be more gradual. Shelving filters may be first-order filter functions which alter the relative gains between frequencies much higher and much lower than the cutoff frequencies, or they may be parametric, with one or more sections implementing a second-order filter. A low shelf is adjusted to affect the gain of lower frequencies while having no effect well above its cutoff frequency. A high shelf adjusts the gain of higher frequencies only. A parametric shelving filter, on the other hand, has one or more sections each of which implements a second-order filter function. This involves at least three arguments; the center frequency, the Q, and the gain which determines how much those frequencies are boosted or cut relative to frequencies much above or below the center frequency selected.

The PSCP filter can also contain, inter alia, band stop (also known as band-rejection) or band pass filter characteristics. A band-stop filter will pass most frequencies, but will attenuate a specific range of frequencies. A band pass filter, on the other hand, will only pass a specific range and attenuate any frequencies outside that range. These filters enable narrow band modifications to the PSCP profile. These are called the PSCP Local Modifier Controls (LMC). The local modifier controls can increase or decrease the sound level or other characteristics at certain, limited frequencies. The spectral response of each of these filters is definable with parameters, for example a center frequency, gain and Q-value.

The PSCP profile can be a direct roll-off towards high frequencies in the log frequency scale. Alternatively, the PSCP profile can deviate from the straight line, and produce emphasis or de-emphasis of certain frequencies. In this way, for example, the PSCP can adjust the bass-to-midrange balance and midrange-to-high frequency balance independently while still applying a global emphasis on the whole frequency range, emphasizing the low frequencies more than high frequencies. The local modifier controls can create the tonal character familiar to the specific user. The PSCP mechanism ensures that this same tonality is then available across all loudspeaker systems where PSCP is used.

In systems without the PSCP, traditional tone controls adjust the bass frequency level and the high frequency level. These cannot adjust the midrange detail or the precise shape of the system frequency response in the way that the PSCP filter can. In addition, a traditional graphical equalizer has fixed center frequencies and fixed Q-values, and cannot create a freely defined modification to the sound color. For that reason, graphical equalizers are too limited for practical use in many applications. The traditional graphical equalizer cannot create the adjustment offered by the PSCP filter. A freely adjustable parametric filter does not necessarily produce the same effect as the PSCP filter, as the PSCP filter works globally and similarly in all loudspeakers. The use of the PSCP requires that all loudspeakers have been first calibrated to create a flat neutral frequency response in the room.

The loudspeaker has additional signal processing filters that can be used to implement the PSCP filtering. The system management user interface has means of globally settings the PSCP filter into all loudspeakers in the system collectively. The PSCP filter is similarly applied in all of the loudspeakers. The PSCP can be stored in a user configured location, which referring to FIG. 4, comprises the loudspeakers' (101, 110) RAM or ROM memory, the external control unit 106, a personal computer (PC) 102, a mobile device 104, which may be e.g. a smartphone or tablet, or a cloud network (103) which provides a connection to a remote server (105). The PSCP may also be downloaded and saved to a media storage device such as a portable hard drive, USB memory stick, CD-ROM. This allows backing up the created PSCP profile or transferring the profile to a system which lacks connectivity. In some embodiments, the profile is downloaded directly from the external control unit.

In an exemplary embodiment, presented in FIG. 4, the loudspeakers 100, 110 (with the respective control modules 101, 109) are connected to each other and other devices via a control network (depicted by dotted lines). The other devices comprise an external control unit or module 106, which may be connected to peripherals, for example a measuring microphone 108 or a volume control 107, or headphones (not shown). The loudspeakers 100, 110 may be connected directly or via the external control unit 106 to additional devices such as a personal computer (PC) 102, a mobile device 104, which may be e.g. a smartphone or tablet, or a cloud network (103) which provides a connection to a remote server (105).

The control network referenced in FIG. 4 by the dotted line allows data transmission for the PSCP control and for other purposes. The control network may comprise. The control network may configured to operate in accordance with Ethernet, RS485, serial communication, wireless communication (including but not limited to Bluetooth, WiFi), mobile wireless communication (GSM, GPRS, 3G), optical communication methods global system for mobile communication, GSM, wideband code division multiple access, WCDMA, 5G, long term evolution, LTE, IS-95, wireless local area network, WLAN, Ethernet and/or worldwide interoperability for microwave access, WiMAX, standards, for example.

Comprised in control modules 101 and 109 and in external control unit 106 is a processing core, which may comprise, for example, a single- or multi-core processor wherein a single-core processor comprises one processing core and a multi-core processor comprises more than one processing core. The processor may comprise more than one processor. A processing core may comprise, for example, a Cortex-A8 processing core manufactured by ARM Holdings or a Steamroller processing core produced by Advanced Micro Devices Corporation. The processor may comprise at least one Qualcomm Snapdragon and/or Intel Atom processor. The processor may comprise at least one application-specific integrated circuit, ASIC. The processor may comprise at least one field-programmable gate array, FPGA. The processor may be means for performing method steps in devices. The processor may be configured, at least in part by computer instructions, to perform actions.

Comprised in control modules 101 and 109 and in external control unit 106 may be a memory. The memory may comprise random-access memory and/or permanent memory. The memory may comprise at least one RAM chip. The memory may comprise solid-state, magnetic, optical and/or holographic memory, for example. The memory may be at least in part accessible to the processor. The memory may be at least in part comprised in the processor. The memory may be means for storing information. The memory may comprise computer instructions that the processor is configured to execute. When computer instructions configured to cause processor to perform certain actions are stored in the memory, and the device overall is configured to run under the direction of the processor using computer instructions from the memory, the processor and/or its at least one processing core may be considered to be configured to perform said certain actions. The memory may be at least in part comprised in the processor.

Device 300 may comprise a transmitter 330. Device 300 may comprise a receiver 340. Transmitter 330 and receiver 340 may be configured to transmit and receive, respectively, information in accordance with at least one cellular or non-cellular standard. Transmitter 330 may comprise more than one transmitter. Receiver 340 may comprise more than one receiver. Transmitter 330 and/or receiver 340 may be Adjusting the PSCP via a mobile device or personal computer may be done via a graphical user interface. The user interface may comprise a software program, such as an app, or alternatively or additionally a web page. Adjusting the PSCP, including activation and deactivation, may be done via voice control, pressing a button, via a touchscreen, using computer peripherals such as a mouse and keyboard and other modalities such as e.g. clapping.

It is to be understood that the embodiments of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting.

Reference throughout this specification to one embodiment or an embodiment means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment. Where reference is made to a numerical value using a term such as, for example, about or substantially, the exact numerical value is also disclosed.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and example of the present invention may be referred to herein along with alternatives for the various components thereof. It is understood that such embodiments, examples, and alternatives are not to be construed as de facto equivalents of one another, but are to be considered as separate and autonomous representations of the present invention.

Furthermore, the described features, structures, or characteristics may be combined in any suitable manner in one or more embodiments. In this description, numerous specific details are provided, such as examples of lengths, widths, shapes, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The verbs "to comprise" and "to include" are used in this document as open limitations that neither exclude nor require the existence of also un-recited features. The features recited in depending claims are mutually freely combinable unless otherwise explicitly stated. Furthermore, it is to be understood that the use of "a" or "an", that is, a singular form, throughout this document does not exclude a plurality.

INDUSTRIAL APPLICABILITY

At least some embodiments of the present invention find industrial application in audio engineering.

REFERENCE SIGNS LIST

| | |
|---|---|
| 100 | Loudspeaker |
| 101 | Control module of loudspeaker |
| 102 | Personal computer |
| 103 | Cloud, i.e. remote computer network |
| 104 | Mobile device |
| 105 | Server |
| 106 | External control unit |
| 107 | Volume control |
| 108 | Microphone |
| 109 | Control module of loudspeaker |
| 110 | Loudspeaker |

The invention claimed is:

1. An apparatus comprising:

at least one loudspeaker element, at least one processing core, at least one memory including computer program code, the at least one memory and the computer program configured to, with the at least one processing core, cause the apparatus to produce sound via the loudspeaker element, wherein the at least one processing core is configured to adjust the sound according to a sound character profile stored in the at least one memory, wherein the sound character profile comprises a wide bandwidth roll-off using at least one parametric shelving filter and data relating to user identification.

2. An apparatus according to claim 1, wherein the apparatus is configured to receive the sound character profile from an external system.

3. An apparatus according to claim 2, wherein the sound character profile comprises at least two parametric shelving filters.

4. An apparatus according to claim 3, wherein the parameters of the shelving filter comprise at least one of the frequency location of the filter and the slope of the filter profile.

5. An apparatus according to claim 4, wherein the filter comprises band stop or band pass characteristics.

6. An apparatus according to claim 5, wherein the apparatus is configured to effect the adjustment using additional signal processing filters in the memory.

7. An apparatus according to claim 6, wherein the apparatus is configured to generate the sound character profile at least in part in response to input obtained via a graphical user interface.

8. An apparatus according to claim 7, wherein the apparatus is further configured to store the sound character profile on an external device.

9. An apparatus according to claim 8, wherein the apparatus is configured to use the sound character profile with headphones.

10. An apparatus according to claim 9, wherein the apparatus comprises an amplifier.

11. An apparatus according to claim 1, wherein the sound character profile is automatically adjusted based on at least one of: hardware identity, location-related criteria, measured results, iterative tuning, or calculations or evaluations done off-site.

* * * * *